US012091823B2

(12) United States Patent
Jones

(10) Patent No.: US 12,091,823 B2
(45) Date of Patent: Sep. 17, 2024

(54) EDGE RESTRAINT WITH MECHANISM FOR RESTRICTED HORIZONTAL MOVEMENT

(71) Applicant: Stephen Jones, Prior Lake, MN (US)

(72) Inventor: Stephen Jones, Prior Lake, MN (US)

(73) Assignee: PAVE TECH, INC., Prior Lake, MN (US)

( * ) Notice: Subject to any disclaimer, the term of this patent is extended or adjusted under 35 U.S.C. 154(b) by 755 days.

(21) Appl. No.: 17/178,895

(22) Filed: Feb. 18, 2021

(65) Prior Publication Data

US 2021/0254288 A1 Aug. 19, 2021

Related U.S. Application Data

(60) Provisional application No. 62/978,659, filed on Feb. 19, 2020.

(51) Int. Cl.
*E01C 11/22* (2006.01)

(52) U.S. Cl.
CPC ..... *E01C 11/221* (2013.01)

(58) Field of Classification Search
CPC ..... E01C 11/221
See application file for complete search history.

(56) References Cited

U.S. PATENT DOCUMENTS 1,226,149 A 5/1917 Warmoth
1,977,021 A 10/1934 Spencer
2,713,751 A 7/1955 Hendrixson
2,782,561 A 2/1957 Smith
3,277,606 A 10/1966 Cohen
3,281,988 A 11/1966 Cohen
3,373,668 A 3/1968 Moore et al.
3,378,949 A 4/1968 Dorris
3,520,082 A 7/1970 Smith
(Continued)

FOREIGN PATENT DOCUMENTS

CH 708410 B1 5/2017
GB 2518183 A 3/2015
(Continued)

OTHER PUBLICATIONS

International Search Report and Written Opinion issued for PCT/US2021/018538, dated May 20, 2021.
(Continued)

*Primary Examiner* — Abigail A Risic
(74) *Attorney, Agent, or Firm* — Z. Peter Sawicki; Amanda M. Prose; Westman, Champlin, & Koehler PA

(57) ABSTRACT

An edge restraint and method of use where the edge restraint has a vertical wall for retaining segmental pavement in an installation placement and a horizontal base having a plurality of teeth extending therefrom and providing discrete focused points for providing friction between the edge restraint and an installation surface to prevent horizontal movement of the edging in at least one direction with respect to the installation surface. A leading edge of the base is installed under a first surface with the wall providing a barrier between the first surface and a second surface for engaging the teeth with a third surface to prevent movement of edging in a horizontal direction away from the first surface.

15 Claims, 10 Drawing Sheets

(56) References Cited

U.S. PATENT DOCUMENTS

| | | | | |
|---|---|---|---|---|
| 3,545,127 | A * | 12/1970 | Jensen | A01G 9/28 47/33 |
| 4,831,776 | A | 5/1989 | Fritch | |
| 4,863,307 | A | 9/1989 | Jones | |
| RE33,550 | E | 3/1991 | Jones | |
| 5,073,061 | A * | 12/1991 | Jones | E01C 11/221 404/8 |
| 5,102,256 | A | 4/1992 | Gosnell | |
| 5,212,917 | A | 5/1993 | Kurtz et al. | |
| 5,240,343 | A | 8/1993 | Strobl, Jr. | |
| 5,660,377 | A * | 8/1997 | Specht | E04H 17/127 256/45 |
| 5,769,562 | A | 6/1998 | Jones | |
| 5,993,107 | A | 11/1999 | Bauer | |
| 6,030,144 | A * | 2/2000 | Cannella | A01G 9/28 47/33 |
| 6,071,038 | A | 6/2000 | Strobl, Jr. | |
| 6,099,201 | A | 8/2000 | Abbrancati | |
| 6,379,078 | B1 | 4/2002 | Zwier | |
| 6,409,421 | B1 * | 6/2002 | Jones | A01G 9/28 404/7 |
| 6,449,897 | B1 | 9/2002 | Gaston | |
| 6,464,199 | B1 | 10/2002 | Johnson | |
| D516,228 | S | 2/2006 | Dunbar | |
| 7,963,718 | B2 | 6/2011 | Zwier et al. | |
| 9,206,561 | B2 | 12/2015 | Alfieri, III | |
| 10,240,303 | B2 | 3/2019 | De Valdivielso | |
| 2009/0060656 | A1 * | 3/2009 | Szkola | E01C 11/221 404/68 |
| 2009/0223121 | A1 * | 9/2009 | Jones | E01C 11/221 47/33 |
| 2009/0224425 | A1 | 9/2009 | Ness | |
| 2009/0232597 | A1 * | 9/2009 | Zwier | E01C 11/221 404/17 |
| 2010/0050505 | A1 | 3/2010 | Zwier | |
| 2011/0173901 | A1 * | 7/2011 | Runkles | E01C 11/221 52/169.1 |
| 2016/0090706 | A1 * | 3/2016 | Johnson, Jr. | E01C 11/221 405/114 |
| 2016/0222601 | A1 * | 8/2016 | Alfieri, III | E01C 11/221 |
| 2018/0371706 | A1 * | 12/2018 | Ziegan | A01G 9/28 |
| 2021/0127599 | A1 * | 5/2021 | Guerrini | A01G 9/28 |

FOREIGN PATENT DOCUMENTS

| | | | |
|---|---|---|---|
| KR | 101282096 | B1 | 7/2013 |
| RU | 2000377 | C1 | 9/1993 |
| WO | 90/05213 | A1 | 5/1990 |

OTHER PUBLICATIONS

European Search Report issued for related EP patent application Serial No. 21757529.9, dated Apr. 15, 2024.

* cited by examiner

EDGE RESTRAINT WITH MECHANISM FOR RESTRICTED HORIZONTAL MOVEMENT

CROSS-REFERENCE TO RELATED APPLICATION

The present application is based on and claims the benefit of U.S. provisional patent application Ser. No. 62/978,659, filed Feb. 19, 2020, the content of which is hereby incorporated by reference in its entirety.

BACKGROUND

Edging is used as perimeter support for various outdoor surfaces such those comprised of segmental pavers. The edging is provided to secure in place systems of segmental pavers such as patios, walkways, driveways or other surfaces constructed from the laying of segmental paving bricks or stones (segmental pavers). The edging is also intended to prevent pavement edge failure. This edging is most frequently comprised of a plastic or aluminum material and is provided in selected lengths according to a perimeter shape of a segmental paver surface for use during installation. The edging has a vertical and horizontal surface intended to allow the edging to push back against the segmental pavers to resist outward push of the pavers or pavement. The edging is secured in place during installation by way of stakes driven vertically into and through a substantially angled or inclined wall of the edging and into the ground surface. The stakes are spaced apart and driven into the edging in intervals generally ranging from 1 foot to 3 feet along the length of the edging.

Overtime, the edging can be moved from its original installation position due to various forces, including those from everyday maintenance or use of the segmental pavement the edging.

SUMMARY

An aspect of the present disclosure relates to an edge restraint having a vertical surface for retaining a segmental paver surface and a horizontal surface for positional support of the edge restraint and wherein a bottom surface of the horizontal surface has a plurality of teeth, each of the teeth having a discrete focused point for proving friction between the edge restraint and an installation surface to prevent horizontal movement of the edge restraint in at least one direction with respect to the installation surface.

The vertical surface extends upwardly from connection with a top surface of the horizontal surface and wherein the plurality of teeth are spaced apart along a width of the horizontal surface and extend downwardly from the bottom thereof.

The teeth comprise an angled section extending from a first end of a first vertical riser to an opposite end of a second, adjacent vertical riser.

The angled section extends from the first end of the first vertical riser at an acute angle.

A reinforcing surface extends from the horizontal surface to a selected position on the vertical surface. The reinforcing surface is an angled surface extending from the horizontal surface at an acute angle to connection with a position on a lower half of the length of the vertical surface.

In one or more embodiments, the horizontal surface has a plurality of notches spaced apart along a length and extending from edges of the horizontal surface toward the vertical surface to form a tongue and groove mechanism along the length of the edging.

Another aspect of the present disclosure relates to a method of installing edge restraint including positioning a leading edge of a base under a first surface such that a wall extending upwardly from the base provides a barrier between the first surface and a second surface and engaging a plurality teeth or gripping surfaces spaced apart along the base with a third surface to prevent movement of the edge restraint in a horizontal direction away from the first surface.

At least one of the first surface and second surface are a surface comprising a plurality of pavers, bricks, stones or the like and wherein the third surface is a ground surface or a base surface for the first and/or second surface.

The plurality of teeth are configured such that the edge restraint is horizontally moveable in a direction toward the first surface while concurrently being retained in a manner such that the teeth prevent movement in the horizontal direction away from the first surface.

Driving one or more fasteners into one or more apertures provided along a length of the edge restraint retains the length of edge restraint along a selected path extending between the first and second surfaces during installation of the edge restraint.

Each of the teeth or gripping surfaces comprise a surface extending downwardly from the base terminating in a focused friction point where each adjacent friction point is spaced apart by an angled portion of the base extending from a bottom end of a first downward surface to an upper end of a second adjacent downward surface.

Another aspect of the present disclosure relates to a length of edge restraint having a base portion having a width, a wall extending upwardly from the base, and a plurality of surfaces extending downwardly from the base each terminating in a friction point where the friction points are each spaced apart on the base.

In one embodiment the friction points are spaced apart by angled portions of the base extending from a first end of a first one of the plurality of surfaces to a second opposing end of a second adjacent one of the plurality of surfaces.

In one embodiment the friction points are spaced apart from one another in rows or offset rows and each friction point is a discrete element extending downwardly from the base and having a conical or pyramidal shape with a pointed end facing downwardly.

There are three or more friction points on the width of the base.

A reinforcement surface is positioned on a first side of the wall and connected to the base and the wall.

When the friction points are engaged with a ground surface, the friction points prevent horizontal movement of the length of the edge restraint from force applied to a second opposing side of the wall.

DETAILED DESCRIPTION

Figure 1A:
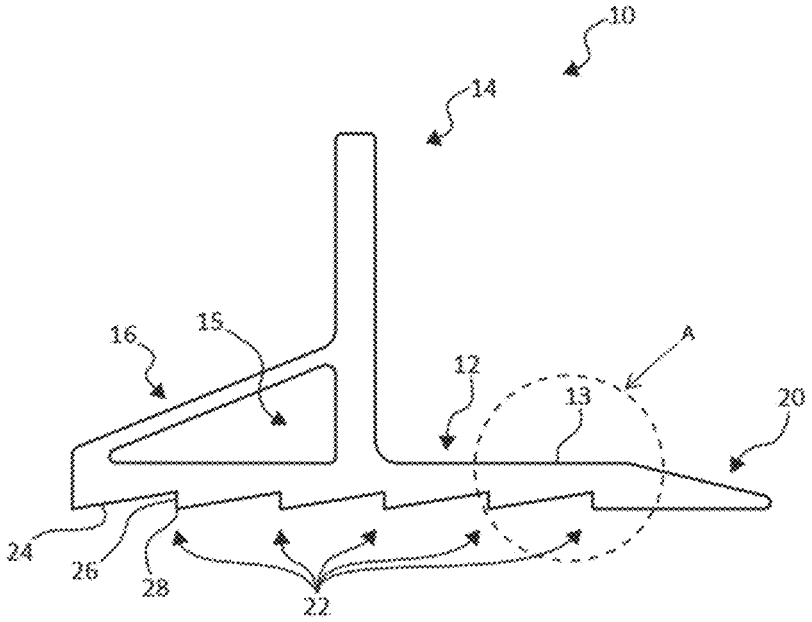
FIG. 1A is a side view of edge restraint according to embodiments described herein.
Figure 1B:
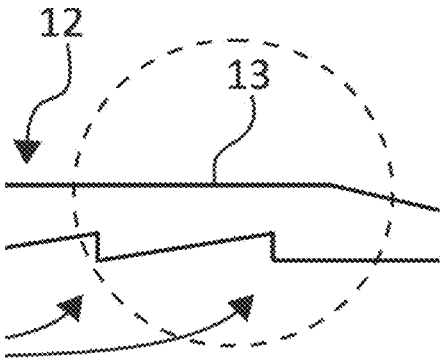
FIG. 1B is a partial view of the side view of edge restraint, enlarged for magnification purposes.
Figure 2:
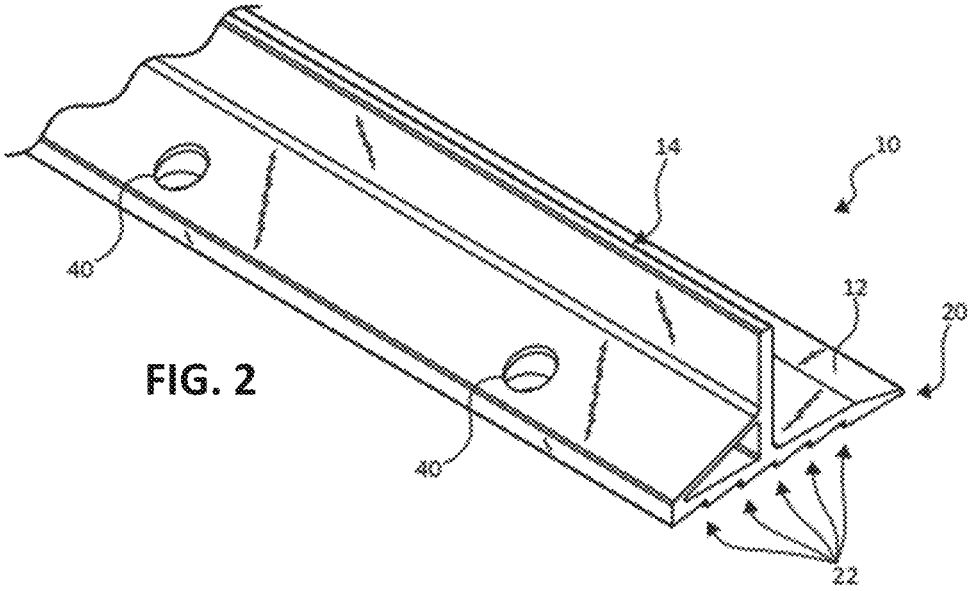
FIG. 2 is a perspective view of the edge restraint.
Figure 3:
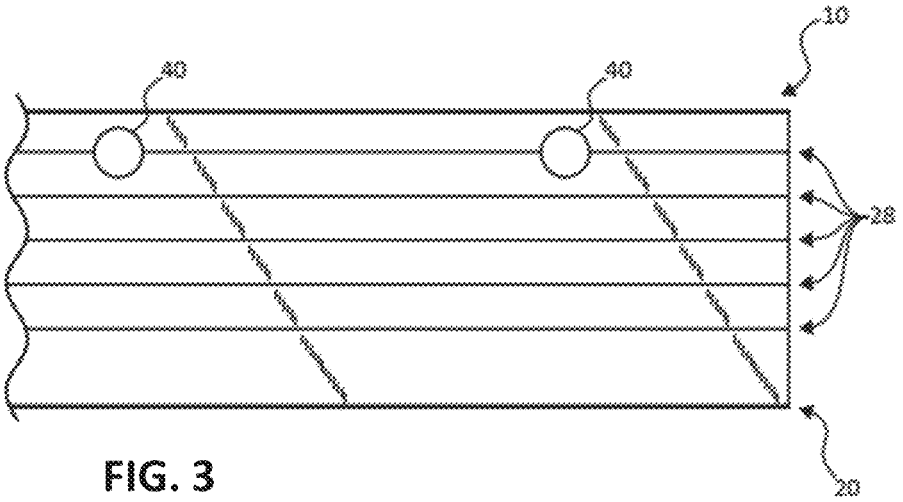
FIG. 3 is a bottom view of a length of edge restraint.

Edge restraint for supporting a segmental pavement surface and protecting the paver surface and blocks positioned on a ground surface according to one or more embodiments described herein provides directional resistance to horizontal movement of the edging itself. The edge restraint comprises a base providing a plurality of discrete focused points of friction to prevent horizontal movement of the edging in at least one direction when forces from one or more vertical, horizontal, or angled directions are applied to the edging.

As illustrated in FIGS. 1A-6, edge restraint 10 comprises a base 12 and a vertical wall 14. A reinforcement section 16 is provided at a lower end of the vertical wall 14. The reinforcement length may be an angled wall 17 that supports a vertical wall 14 by way of extending from connection with the base 12 upwardly to a rear location on vertical wall 14 such that there is an open space 15 below reinforcement section 16.

The vertical wall 14 may be positioned at a right angle with respect to the base 12, which is substantially horizontal with respect thereto. The vertical wall 14 may extend upwardly from a substantially central portion on a width of the base 12 or may be offset from the center portion of the width of the base 12. The angled wall 17 of the reinforcement section 16 may extend from the base 12 at an acute angle to meet the vertical wall 14. In one or more embodiments, the angle may be an acute angle less than about 75 degrees, or less than about 60 degrees, or less than about 45 degrees. Moreover, the wall 17 of the reinforcement section 16 may contact the vertical wall 14 at any location along the height thereof, including at a location on a lower portion or lower half of the height of the vertical wall 14.

As best shown in FIGS. 1A-3, in one embodiment, the base 12 comprises a substantially flat section on an upper surface thereof wherein a bottom surface thereof comprises a plurality of teeth 22 extending therefrom. In the embodiment illustrated, the teeth 22 are spaced apart from each other substantially along the entire width of the base 12 up to a leading edge 20. The teeth 22 each have an angled tread 24 terminating at a distal first terminal point 28 defined by the angled tread 24 meeting a riser 26. Overall, the base 12 has a bottom surface that is generally level or non-sloped meaning that the angled tread 24 of each of the teeth 22 has a length longer than the riser resulting in a slope that defines length of the riser 26 to be shorter than the length of the tread. Each angled tread 24 extends from the first terminal point 28 converges at an opposite end at a start of an adjacent tread 24. That is, each angled tread 24 connects to a first, bottom end of a first riser 26 which is the distal terminal point 28. The angled tread 24 then extends upwardly at an acute angle to terminate and connect with a second, top end of a second, adjacent riser 26. The acute angle at which the angled treads 24 each extend may be the same angle or a different angle. In the embodiment illustrated, each angled tread 24 is angled at substantially the same acute angle as represented by angle θ in the figures. The acute angle may in some embodiments be less than about 75 degrees, or less than about 60 degrees or less than about 45 degrees.

The base 12 may comprise for example, three (4), four (4), five (5), six (6) or more terminal points 28 to provide sufficient spaced apart and discrete focused points of friction for the edge restraint 10 when the edge restraint 10 is installed. The number of terminal points 28 may be selected based on the overall dimensions of the edge restraint 10 and/or an end use of the edge restraint 10. For example, the lowest number of focused points of friction 28 sufficient for preventing and/or resisting horizontal movement of the edge restraint 10 in at least one direction as described in further detail herein, may be preferred. The addition of excess points of friction 28 in some embodiments may instead reduce the effectiveness of the edge restraint 10 by distributing the resistive friction to thinly with respect to the overall size of the edge restraint 10. Thus, embodiments described herein may utilize a number and positioning of discrete focused points of friction selected based on providing a maximum resistive force to horizontal movement of the edge restraint 10.

The discrete focused points of friction 28 contact a base surface such as prepared ground surface on which the edging is installed and provide directional resistance for the edge restraint 10. The base 12 restricts movement of the edging along the direction of arrow 44 when forces are applied to the edge restraint 10 along, for example, the directions illustrated by arrows 32. The edge restraint 10 concurrently allows for horizontal movement along the direction of arrow 42, which is a reciprocal direction to arrow 44. The base 12 is configured to allow for easy placement of the edging along the direction of arrow 44 to support surfaces positioned on base 12 and supported by a front face of vertical wall 14. Movement along the direction of arrow 44 is prevented to retain the edge restraint 10 in the selected installed position such that forces applied to the segmental pavement surface in the direction of arrows 32 do not displace the edge restraint 10. This allows the segmental pavement surface to be retained in its installation position and prevent migration of the components.

The teeth 22 including each angled tread 24 and riser 26 as well as the terminal point 28 connecting the angled tread 24 and riser 26 may have varying dimensions depending at least in part on the selected end use of the edge restraint 10 and thus overall size of the edge restraint 10. These dimensions are within an optimal range sufficient for each point 28 to provide frictional resistance to directional forces in a manner which substantially prevents horizontal movement of the edge restraint 10 in the direction of angle 44 when the edge restraint 10 is installed. The riser 26 is a substantially vertical riser 26 (that is generally perpendicular to the ground surface) and the angled tread 24 extends at an acute angle from terminal point 28 to a upper end of an adjacent vertical riser 26 to provide such resistance. The length of the angled tread may vary as well as the acute angle at which said tread 24 connects two adjacent risers 26 also of varying vertical length. As an illustrative example in the embodiment illustrated, the riser 26 has a height of less than about ½ an inch, or more preferably less than about ¼ inch, or more preferably less than about ⅛ inch or less.

Figure 4:
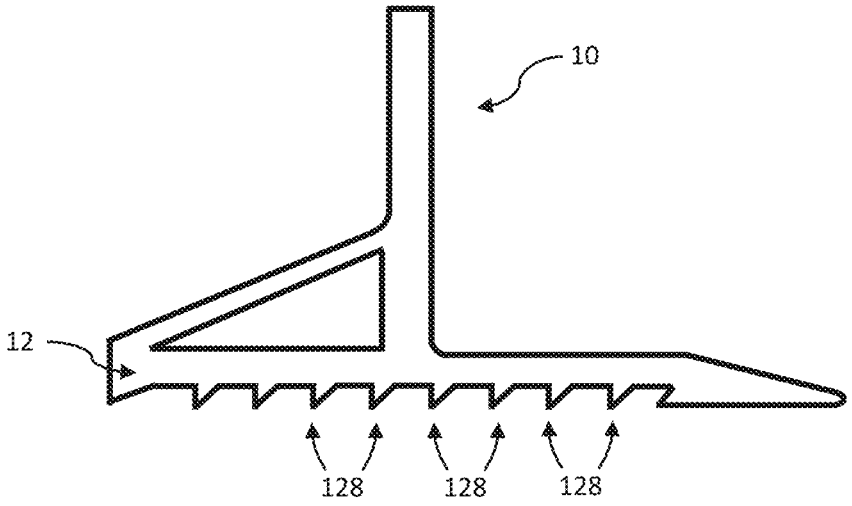
FIG. 4 is a side view of an additional embodiment of the base of the edge restraint.
Figure 5:
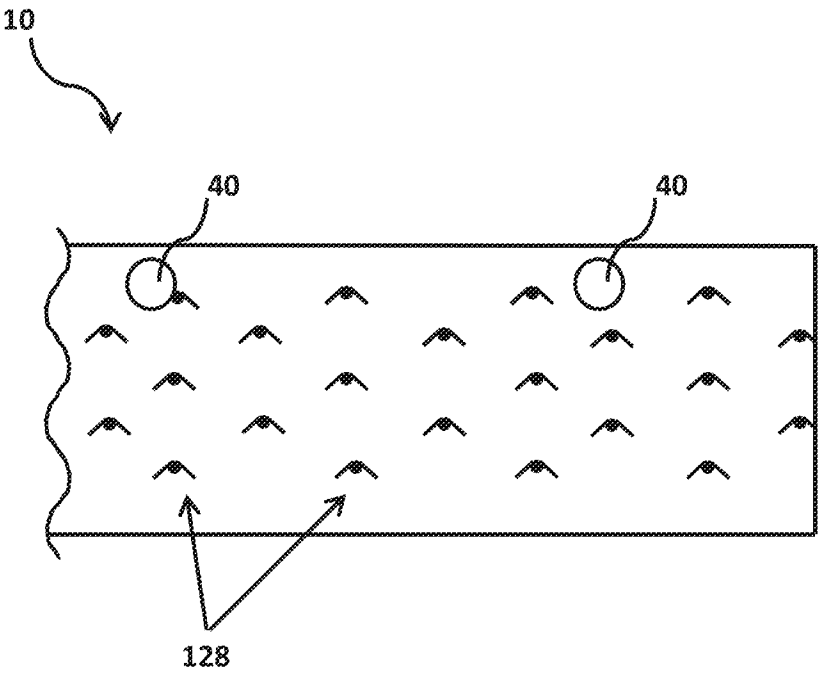
FIG. 5 is a bottom view of a length of the additional embodiment of the edge restraint.

In the embodiment illustrated in FIGS. 4-5, the focused points of friction 28 are provided as discrete protrusions 128 from the base 12. These protrusions 128 may be selectively spaced apart along substantially entire surface of the base 12 and along substantially the entire selected length of the edge restraint 10. The protrusions 128 may be provided in a plurality of rows where the protrusions 128 in adjacent rows are aligned or offset from one another. The protrusions 128 may be referred to as spikes or cleats and may have a pointed tip with a base of varying geometries. For example, the protrusions may have an overall conical or pyramidal shape with a pointed end extending away from the base 12 for engagement with the ground surface. The protrusions 128 may otherwise be tapered along their length as they extend outwardly from the base 12. In these embodiments, the protrusions 128 may be formed on or with the base 12 as the edge restraint is formed by injection molding. The protrusions 128 are also angled protrusions 128 such that the protrusions 128 extend from the base 12 at an acute angle with respect to the base 12 surface. Additionally, or alternatively, the pointed tips of the protrusions 128 may be directionally angled. In one or more embodiments, the angle may be one or more of an acute angle less than about 75 degrees, or less than about 60 degrees, or less than about 45 degrees.

A protruding length and a base cross-sectional dimension of the angled protrusions 128 may vary as well as the acute angle at which said angled protrusion extends from the base 12. As an illustrative example the angled protrusions 128 may have a protrusion length of less than about ½ an inch, or more preferably less than about ¼ inch, or more preferably less than about ⅛ inch or less. A ground contact end 130 of the protrusions 128 has a smaller cross-sectional dimension than a base contact end 132 of the protrusion. By way of non-limiting example, the ratio of the cross-sectional dimension of the ground contact end 130 to the base contact end 132 may be about 1:2, or about 1:3 or about 1:4, or about 1:5.

The edge restraint 10 of the embodiments described herein is a restraint designed to resist the horizontal load from traffic on a segmental paver pavement surface. Lateral and horizontal loads on the paver surface come from pedestrian and vehicle traffic and from freezing and thawing of the base or ground surface as well as soil and/or moisture issues. The focused points of friction 28 aid in restraining the segmental pavement surface and maintaining installation placement of the segmental pavement surface by resisting movement regardless of the lateral and/or horizontal forces applied to the segmental pavement surface. Edging of the prior art will move in a direction horizontal to the ground surface when forces from foot and vehicle traffic or from ground shifts due to moisture and/or temperature changes are applied to the segmental pavement surface and the edge restraint 10 described herein is resistant to such horizontal movement and thus retains the segmental pavement installation in place in a more efficient and long-term manner.

Figure 6:
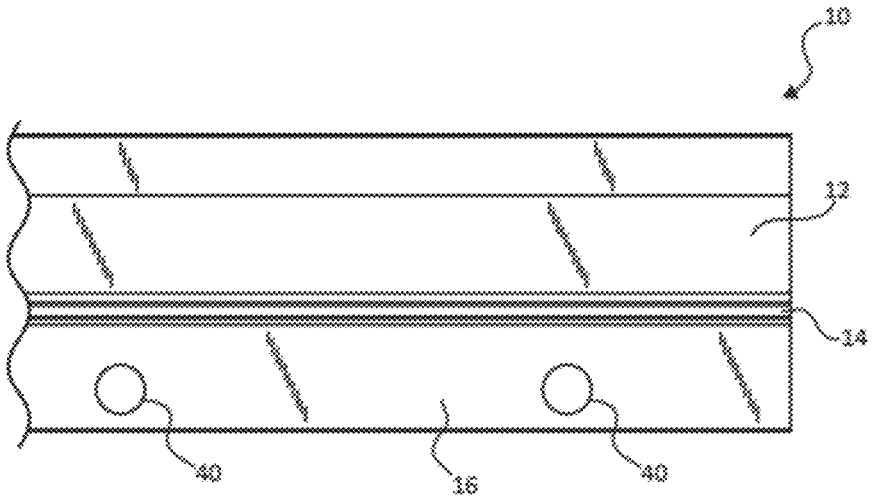
FIG. 6 is a top view of a length of edge restraint.

As illustrated in FIG. 6, one or more apertures 40 may be positioned at spaced apart locations along a length of the edging 10. That is, as longer lengths of edge restraint 10 are selected, the length is selected in part based on a path or perimeter of the segmental pavement surface(s). The edge restraint 10 provides a perimeter transition and retention boundary along selected paths and retains the surfaces within said perimeter. As such, longer lengths of edging may comprise an increasing plurality of apertures to aid in placement during installation of the edge restraint 10 and the segmental pavement surface. In the embodiment illustrated, the apertures 40 are spaced apart along the reinforcement section 16 wherein the apertures extend through the reinforcement section 16 and corresponding apertures are positioned in an aligned location on the base 12 there below. When a fastener such as a stake, spike, or pin is inserted into aperture 40 the stake, spike, or pin is positioned in the aperture 40 as it has a sufficient length to then extend through the base 12 and into the ground surface below the edge restraint 10 to secure the position of edge restraint 10 along a selected path during installation.

Figure 7:
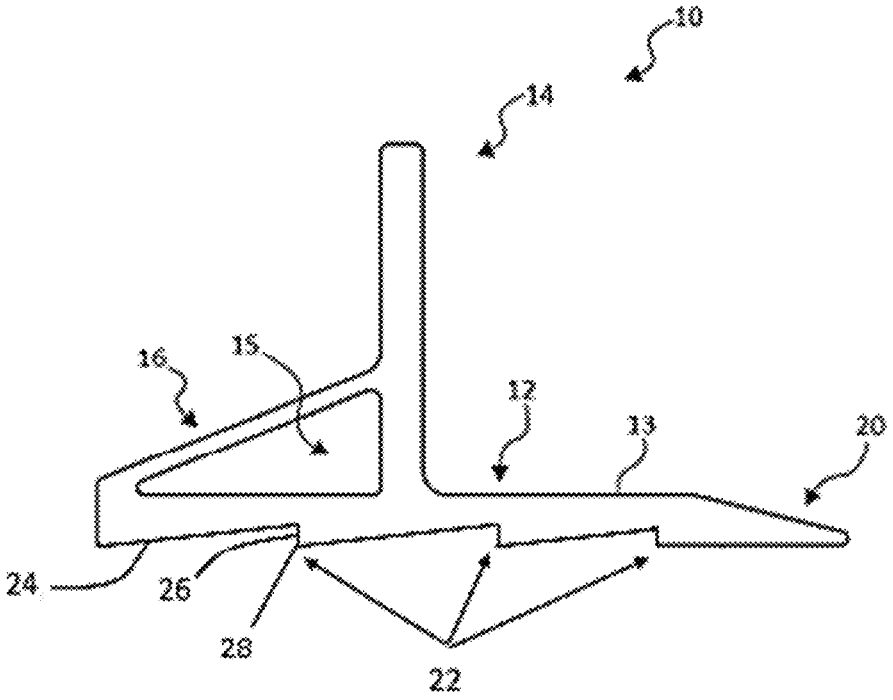
FIG. 7 is a side view of an additional embodiment of the edge restraint.

Illustrated in FIG. 7 is an embodiment of the edge restraint 10 having three (3) gripping mechanisms and a configuration according to one or more embodiments herein.

Figure 8:
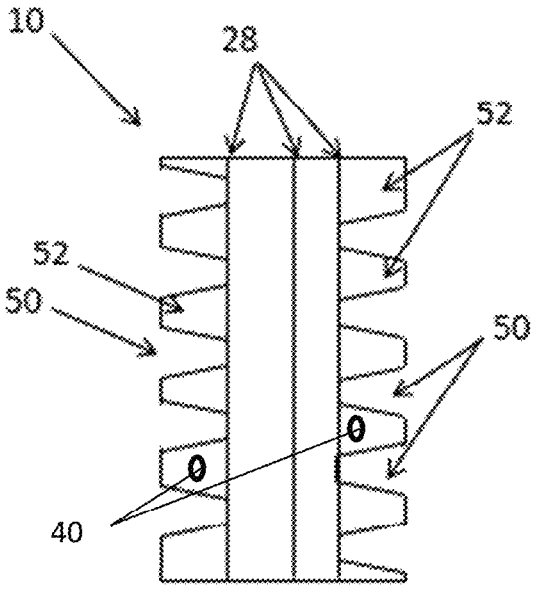
FIG. 8 is a bottom view of an additional embodiment of the edge restraint.

As illustrated in FIG. 8 in one or more embodiments described herein, the edge restraint 10 may have notches 50 along the length of the base 12, forming a tongue and groove mechanism with sections 51 between the notches 50 along the length of the edge restraint 10. The tongue and groove mechanism allows for compact stacking of lengths of the restraint 10 for transport and storage, for example. The tongue and groove mechanism of the lengths of restraints 10 allows compact stacking which adds stability in stacking lengths for storage and/or transport without sacrificing the restraint provided when the edge restraint 10 is installed.

In the embodiments illustrated the edge restraint 10 is a monolithic structure provided in selected lengths where the lengths may range from a minimum of about one foot long section increments in any denominator thereof. For example, the edging may be provided in lengths ranging from 2 feet to 10 feet, 15 feet or more. Apertures 40 are provided spaced apart along the length of the edging 10 for purposes of receiving a stake, spike or pin for placing the edging in selected locations during installation. The edge restraint 10 may also be provided as a multi-piece system or construction to allow for flexibility of the edge restraint 10 for providing curved perimeters to segmental pavement surfaces, for example.

Figure 10:
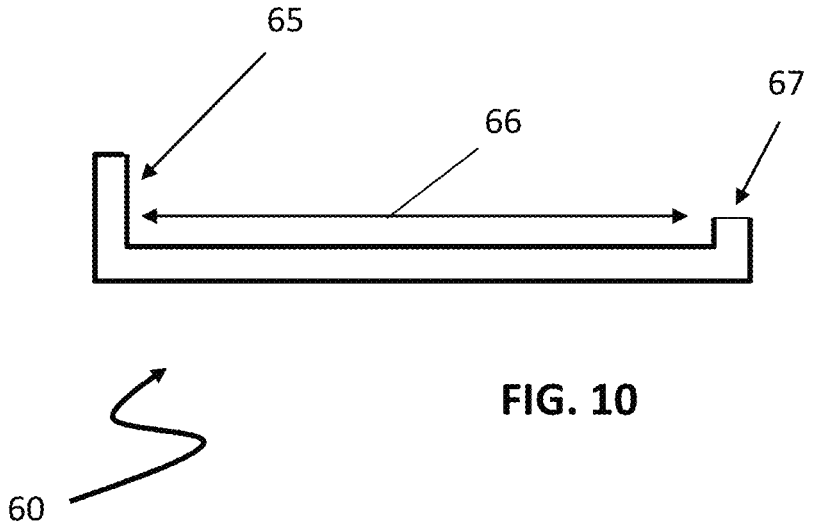
FIG. 10 is a side view of a securing mechanism for an installation surface support substrate.
Figure 11:
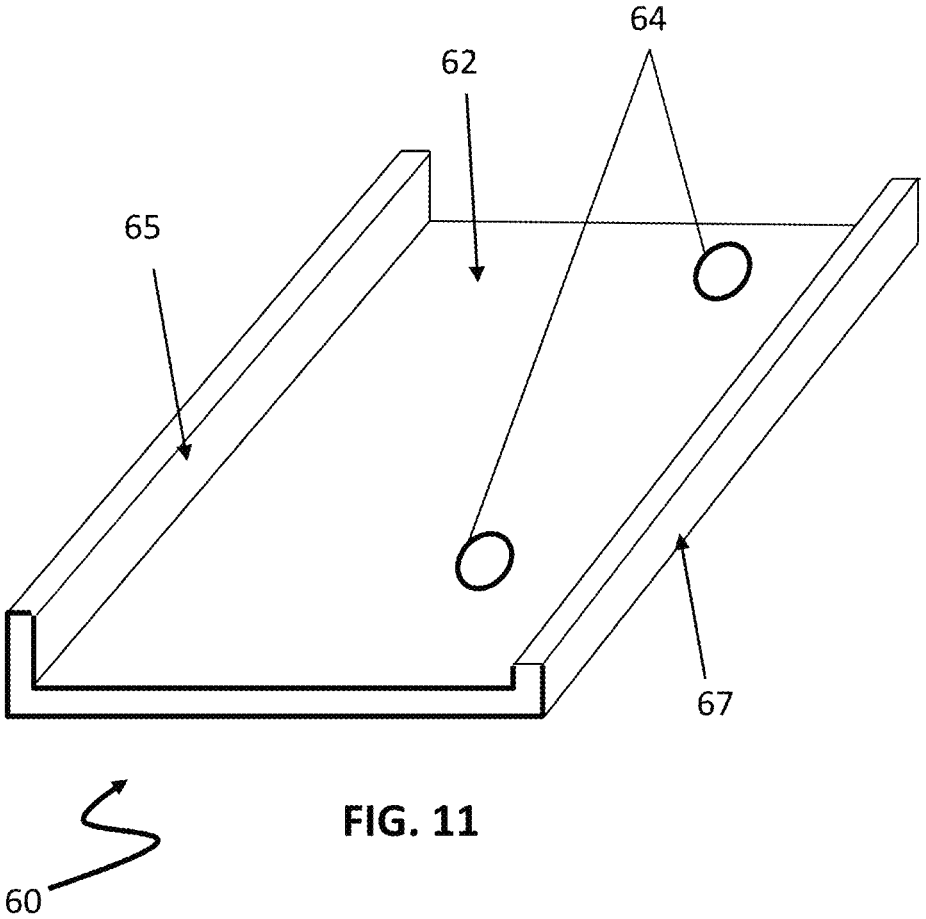
FIG. 11 is a perspective view of the securing mechanism for the installation surface support substrate.

In one or more embodiments as illustrated in FIGS. 10 and 11, the edge restraint 10 is configured for use with a substrate securing mechanism 60 for use in installation. The securing mechanism 60 comprises a strip 62 that may have a length substantially equal to the length of the edge restraint 10. The strip 62 has apertures 64 spaced apart along a length of the strip. The strip 62 has a width 66 bounded by two opposing side walls 65 and 67 which extend downward from the strip 62. The width 66 of the strip 62 is sufficient to allow the securing mechanism 60 to mate with the reinforcement section 16 of the edge restraint 10. The sidewall 65 extends downward to catch a leading edge of the edge restraint 10 and mate with the reinforcement section 16. The securing mechanism 60 may be comprised of the same or a similar material as the edge restraint 10 as described below.

Edge restraint 10 may be a plastic edging or comprising medium density polyethylene, high density polyethylene, polyvinyl chloride, or like materials which provide strength and flexibility to a length of edging for use in various lengths and perimeter shapes for segmental pavement designs. Edging can be comprised of other materials including aluminum or like materials.

The term "segmental pavement surface" as used herein refers generally to the man-made features used in landscape architecture such as paths or other surfaces for pedestrian or vehicle traffic and walls where in contrast to vegetation, the features are constructed from materials such as segmental paver stones or bricks, or the like. By way of non-limiting example, the edge restraint 10 described herein can be used to restrain the segmental pavers forming various features such as paths, walkways, driveways and other features constructed from segmental pavers as well as to restrain base layers of walls such as to restrain and support a first layer of bricks in a retaining wall.

As mentioned previously, the dimensions of the edging design may vary such that the edging may be provided in smaller or larger sizes depending on the materials to be used in the segmental pavement surfaces requiring edging. In one embodiment, edging 10 has overall dimensions wherein the edging 10 is in the range of about 0.75 inches to about 2 inches tall and about 2.0 to about 4 inches wide, with selectable lengths when supporting porcelain pavers or pavers having low heights and the edge restraint 10 may then also be provided in substantially the same construction as described herein but with a height in the range of about 2 to about 4 inches and a width in the range of about 4 inches to about 8 inches. Larger edging 10 may be used for larger format surfaces or surfaces comprises of components having increased heights.

Figure 9:
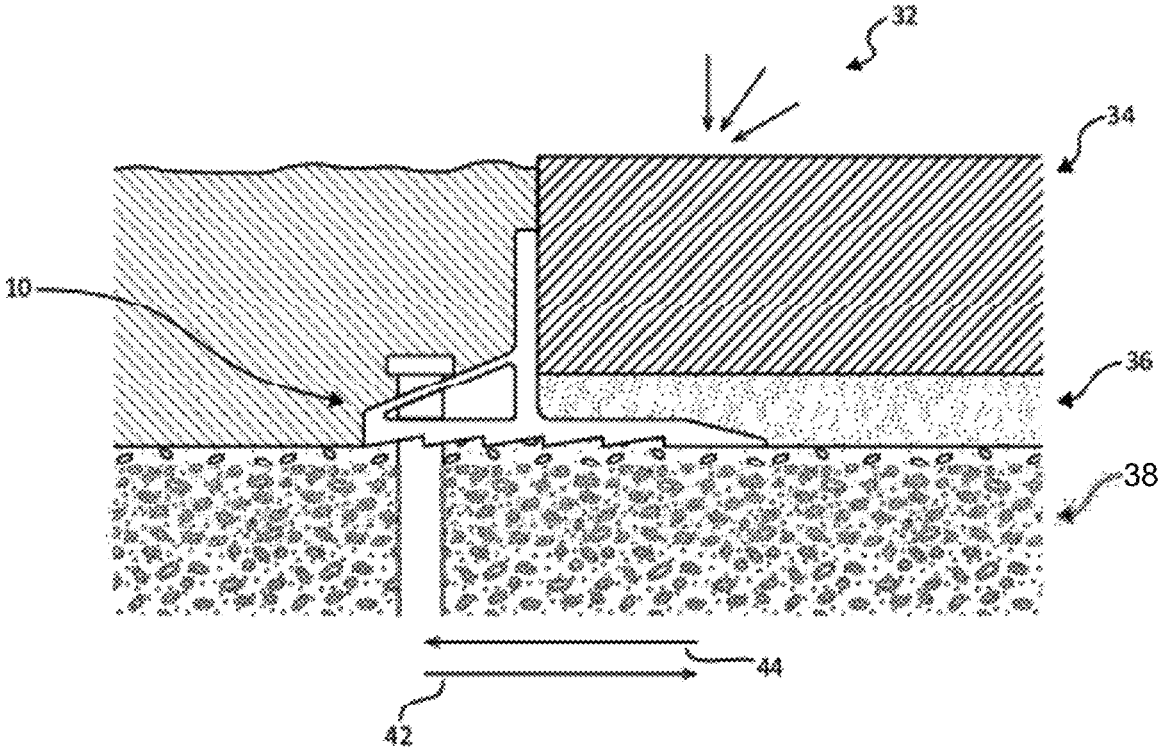
FIG. 9 illustrates an installation of the edge restraint as a reinforcement and paver end protector.

As illustrated in FIG. 9, the edge restraint 10 may be installed on top of a base material 38 and/or bedding material 36 or other surface prepared for the installation of a surface 34 such as segmental pavement which may include a pathway, patio or driveway comprised of pavers or other like materials such as stones, by way of non-limiting example. Installation may include positioning a leading edge 13 of the base 12 under the segmental pavement surface 34 such that the vertical wall 14 extends upwardly from the base 12 to provide a barrier between the first surface 34 and a second surface 46. The teeth 22 then engage the surface 38 below the edge restraint 10 to prevent movement of the edging in the horizontal direction described as a direction away from the surface 34. The teeth may extend substantially across the width of the edge restraint 10 and/or substantially along the entire length of the edge restraint 10 to engage the edge restraint 10 with the ground surface along substantially the entire surface 38 below the edge restraint 10.

Figure 12:
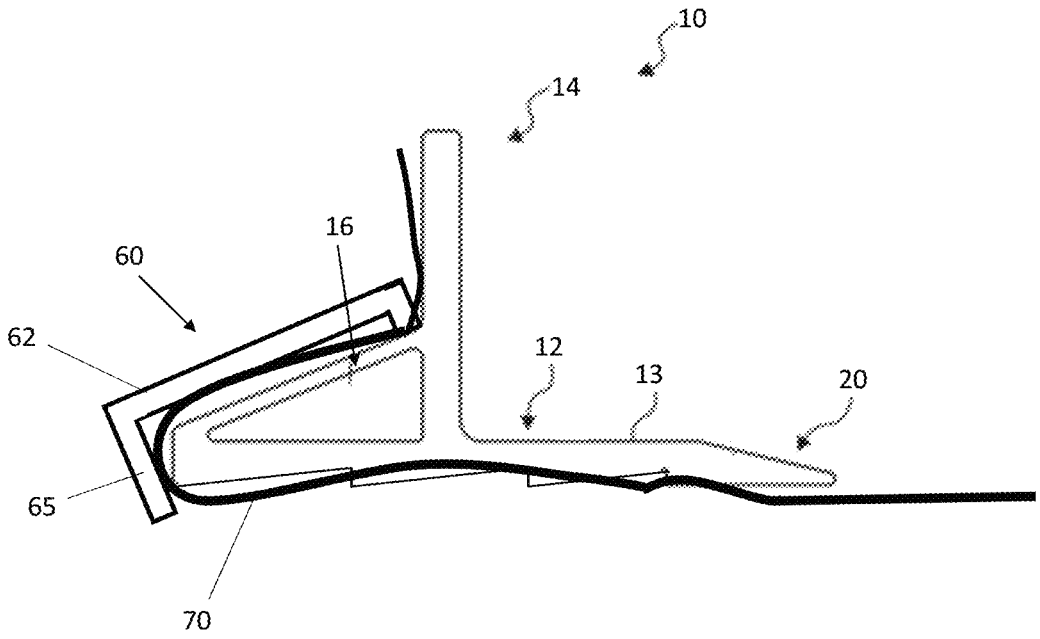
FIG. 12 is a side view showing an assembly order of the securing mechanism in use with the edge restraint.
Figure 13:
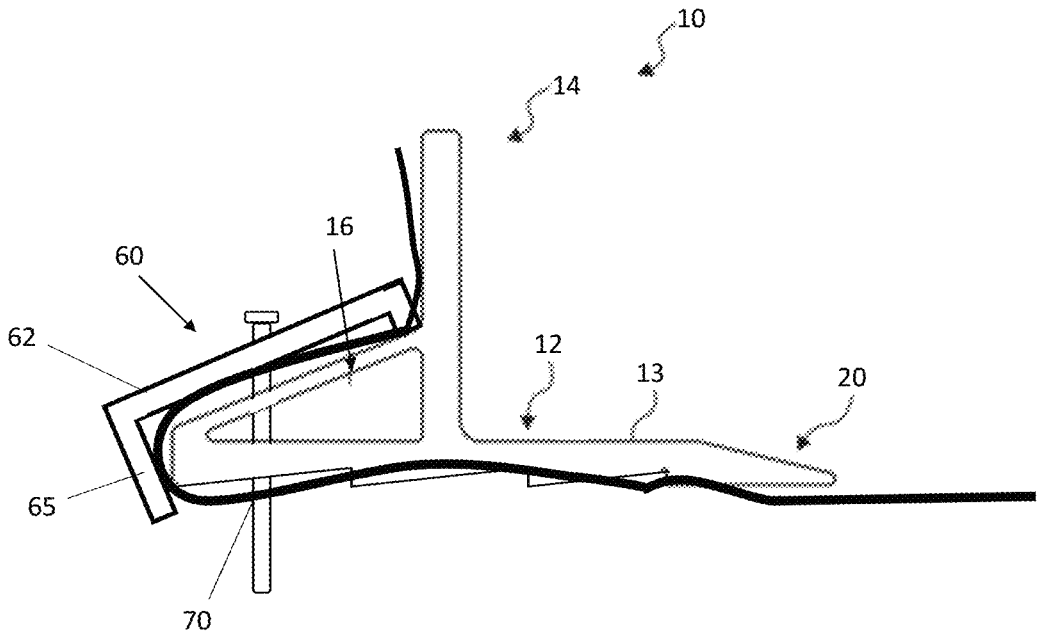
FIG. 13 is a side view showing an assembly order of the securing mechanism in use with a securing pin with the edge restraint.

In one or more embodiments, as illustrated in FIGS. 12-13 a substrate for soil stabilization, for example, Geogrid, may be installed to support the installation surface 34 in an installed position and further prevent movement of the installation surface 34. The securing mechanism 60 may then be installed with the edge restraint 10. With installation, the strip 62 is configured to capture and engage the substrate 70 that is positioned below the edge restraint 10. The substrate material extends under the edge restraint 10 such that the edge restraint is installed over the substrate 70. A terminal end of the substrate 70 is brought up and over the reinforcement section 16 of the edge restraint 10 such that the geogrid extends under the edge restraint 10 and away from the edge restraint and is positioned under the installation surface 34 and bedding 36. The strip 62 is secured over the substrate 70 along the reinforcement section 16 thus clamping or otherwise securing the geogrid 70 between the strip 62 and the edge restraint 10. The strip 62 and thus the substrate 70 can be further secured by way of screws or other fasteners inserted into apertures 64 in the strip 62 which align with apertures 40 in the edge restraint 16 as illustrate in FIG. 13.

In further detail, the edge restraint 10 provides directional resistance to horizontal movement and/or shifting of the edge restraint 10. In the embodiment illustrated, the teeth 22 are positioned such that each terminal point 28 provides an apex point of contact with the base material 38 to focus frictional and directional resistance in a downward manner to prevent horizontal movement in a direction opposite the direction of the incline of angled tread 24 as illustrated by arrow 44. The edging is moveable in the horizontal direction of the incline 24 as shown by arrow 42 to allow for adjustment and/or installation or removal from pre-existing surfaces, however once placed, the terminal points 28 prevent the edging from moving in the direction of arrow 44 such that in the event pavers of other materials impact the edge restraint 10 from the direction of arrows 32 the edge restraint 10 remains in place.

Although the present disclosure has been described with reference to preferred embodiments, workers skilled in the art will recognize that changes may be made in form and detail without departing from the spirit and scope of the disclosure.

The invention claimed is:

1. A length of edge restraint comprising:

a base portion having a width;

a wall extending upwardly from the base;

a plurality of surfaces extending downwardly from the base each terminating in a friction point where the friction points are each spaced apart by angled portions of the base extending from a first end of a first one of the plurality of surfaces to a second opposing end of a second adjacent one of the plurality of surfaces, wherein the angled portions have a length that is longer than a length extending from the base to the friction point and wherein the length extending from the base to the friction points is perpendicular to the width of the base.

2. The length of edge restraint of claim 1, and further comprising a reinforcement surface positioned on a first side of the wall and connected to the base and the wall.

3. The length of edge restraint of claim 1, wherein when the friction points are engagable with a ground surface, the friction points for preventing horizontal movement of the length of edging from force applied to a second opposing side of the wall.

4. The length of edge restraint of claim 1, wherein there are three or more friction points on the width of the base.

5. The length of edge restraint of claim 1 wherein the plurality angled protrusions have a length of less than about ½ an inch, or less than about ¼ inch, or less than about ⅛ inch or less.

6. The length of edge restraint of claim 1, wherein the friction points each have a smaller cross-sectional dimension than a base connection end of the angled protrusion and wherein the ratio of the cross-sectional dimension of the friction point to the base connection end is about 1:2, or about 1:3 or about 1:4, or about 1:5.

7. The length of edge restraint of claim 1 wherein the length of the edge restraint has a tongue and groove mechanism formed by a plurality of tapered notches spaced apart along the length, the tapered notches extending from an edge of the restraint inward along the width of the base portion.

8. A method of installing an edge restraint comprising:

positioning a leading edge of a base under a first surface such that a wall extending upwardly from the base provides a barrier between the first surface and a second surface; and engaging a plurality of teeth spaced apart along the base for engagement with a third surface to prevent movement of edging in a horizontal direction away from the first surface wherein the plurality of teeth are configured such that the edge restraint is horizontally moveable in a direction toward the first surface while concurrently being engaged in a manner such that the teeth prevent the movement in the horizontal direction away from the first surface.

9. The method of claim 8, wherein at least one of the first surface and second surface are a segmental pavement surface comprised of segmental pavers and wherein the third surface is a ground surface or a base surface for the segmental pavement surface.

10. The method of claim 8, further comprising driving one or more fasteners into one or more apertures provided along a length of the edging to aid in retaining the length of edging along a selected path extending between the first and second surfaces during installation of the edge restraint.

11. The method of claim 8, wherein each of the teeth comprise a surface extending downwardly from the base terminating in a focused friction point where each adjacent friction point is spaced apart by an angled portion of the base extending from a bottom end of a first downward surface to an upper end of a second adjacent downward surface.

12. A system for securing a grid for soil stabilization between a rail and an edge restraint, the system comprising:

the edge restraint comprising a base portion having a width and a reinforcing surface extending upwardly from the base, and a plurality of surfaces extending downwardly from the base each terminating in a friction point where the friction points are each spaced apart by angled portions of the base extending from a first end of a first one of the plurality of surfaces to a second opposing end of a second adjacent one of the plurality of surfaces, wherein the angled portions have a length that is longer than a length extending from the base to the friction point and wherein the length extending from the base to the friction points is perpendicular to the width of the base;

the rail having a length having a width, wherein the width terminates in a side wall on at least one edge, and wherein the length is configured to mate with the reinforcing surface of the edge restraint with a first portion of the grid positioned between the rail and the reinforcing side of the edge restraint and a second portion of the grid positioned below the base of the edge restraint; and at least one securing mechanism for securing the system with the rail, the first portion of the grid, the edge restraint, and the second portion of the grid to a ground surface.

13. The system of claim 12 wherein the reinforcing surface is an angled surface extending from a horizontal base surface of the edge restraint at an acute angle to connection with a position on a lower half of a height of a vertical surface of the edge restraint.

14. The system of claim 12 wherein the one or more apertures are configured to align with one or more apertures on the edge restraint and receive one of the at least one securing mechanisms therethrough with the substrate between the rail and the edge restraint.

15. The system of claim 12 wherein the rail is comprised of medium density polyethylene, high density polyethylene, polyvinyl chloride, aluminum or combinations thereof.

* * * * *